US005462067A

United States Patent [19]

Shapiro

[11] Patent Number: 5,462,067

[45] Date of Patent: Oct. 31, 1995

[54] DEVICE FOR HYGIENIC PROTECTION OF THE TEETH AND GUMS

[76] Inventor: Ira Shapiro, P.O. Box 174, Radio City Station, New York, N.Y. 10101

[21] Appl. No.: 292,724

[22] Filed: Aug. 18, 1994

[51] Int. Cl.[6] ..... A61F 5/56

[52] U.S. Cl. ..... 128/861; 128/859; 433/136

[58] Field of Search ..... 128/859, 860, 128/861, 862, 857, 846, 848; 602/52; 433/136, 138, 229; 2/174

[56] References Cited

U.S. PATENT DOCUMENTS

| | | | |
|---|---|---|---|
| 2,257,709 | 9/1941 | Anderson | 128/861 |
| 3,303,844 | 2/1967 | Johnson et al. | 128/862 |
| 3,379,193 | 4/1968 | Monaghan | 128/862 |
| 3,416,527 | 12/1968 | Haef | 128/862 |
| 3,924,638 | 12/1975 | Mann | 128/862 |
| 4,063,552 | 12/1977 | Going et al. | 128/861 |
| 4,185,817 | 1/1980 | Peterson | 128/861 |
| 4,211,008 | 7/1980 | Lerman | 433/229 |
| 4,338,928 | 7/1982 | Martin et al. | 128/857 |
| 4,718,849 | 1/1988 | von Weissenfluh et al. | 433/229 |
| 4,738,259 | 4/1988 | Brown et al. | 128/859 |
| 5,033,480 | 7/1991 | Wiley et al. | 128/861 |
| 5,194,003 | 3/1993 | Garay et al. | 433/229 |
| 5,293,646 | 3/1994 | Winston | 2/174 |

*Primary Examiner*—Robert A. Hafer
*Assistant Examiner*—Michael O'Neill
*Attorney, Agent, or Firm*—Norman B. Rainer

[57] ABSTRACT

A disposable shield device which serves to keep food away from the gums and teeth during eating is made from an integral piece of thin plastic film having a substantially rectangular perimeter defined by opposed end edges and parallel first and second long edges. A compliant strip is positioned along the first edge for fitting against the front gum line. Two slits entering from the second edge define a center flap and paired outer flaps. An adhesive strip positioned on the center flap adjacent the second edge enable the outer flaps to securely overlap the center flap, thereby achieving close fit against the rear gum line.

6 Claims, 1 Drawing Sheet

DEVICE FOR HYGIENIC PROTECTION OF THE TEETH AND GUMS

BACKGROUND OF THE INVENTION

1. Field of the Invention

This invention concerns a device to be worn in a person's mouth during eating for the hygienic protection of teeth and gums.

2. Description of the Prior Art

Devices for protecting a person's teeth and mouth from injury due to impact during sports activities are disclosed in U.S. Pat. Nos. 3,247,844; 3,457,916; 3,496,936; 3,864,832; 4,350,154, and elsewhere. Tooth protectors for use during dental and other medical procedures are disclosed in U.S. Pat. No. 3,513,838, and elsewhere. Such devices either prevent or interfere with normal motion of the jaw, as in chewing food.

Considerable attention is directed toward hygiene of the teeth and gums. For example, most dental authorities recommend frequent use of dental floss and a toothbrush to remove particles of food that lodge between the teeth during eating. It is often difficult for individuals to abide by a strict dental hygiene regimen, and even with conscientious attention to dental hygiene, disorders of the gums and teeth can still be produced by food particles allowed to remain between the teeth adjacent the gum line.

It is accordingly an object of the present invention to provide a disposable shield device to be worn upon the teeth and gums during chewing of food to prevent food particles from lodging between the teeth.

It is another object of this invention to provide a device as in the foregoing object which can be easily emplaced in the user's mouth.

It is a further object of the present invention to provide a device of the aforesaid nature of simple construction amenable to low cost manufacture.

It is yet another object of this invention to provide a dispensing package containing a multitude of the shield devices of the aforesaid nature in stacked relationship.

These and other beneficial objects and advantages will be apparent from the following description.

SUMMARY OF THE INVENTION

The above and other beneficial objects and advantages are accomplished in accordance with the present invention by a gum and teeth protector comprised of a pair of shield devices each comprised of:

a) a piece of thin, initially flat polymeric film elongated between parallel end extremities, and further bordered by straight parallel first and second edges of substantially equal length, said piece of film having two parallel slits beginning at said second edge and extending toward said first edge in orthogonal relationship thereto, said slits defining a center flap and paired outer flaps, b) a compliant strip disposed in association with said first edge, and c) adhesive means interactive between said center and outer flaps to enable said outer flaps to securably overlap said center flap, thereby effectively shortening the length of said second edge.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
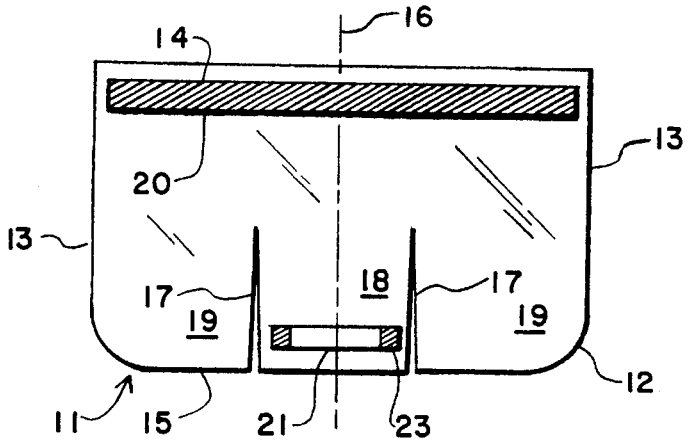
FIG. 1 is a top plan view of an embodiment of the shield device of the present invention shown in its packaged state.
Figure 2:
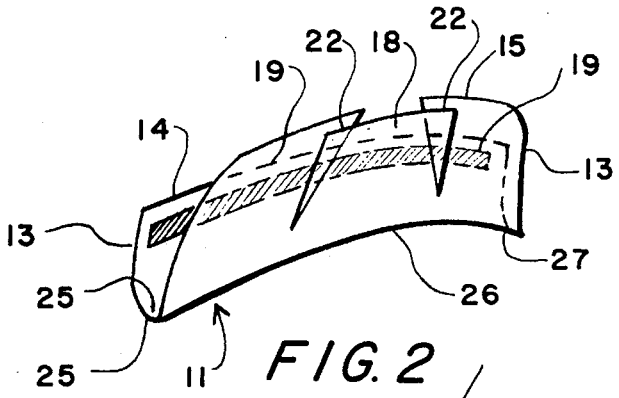
FIG. 2 is a rear perspective view showing the shield embodiment of FIG. 1 as it would appear during use.
Figure 3:
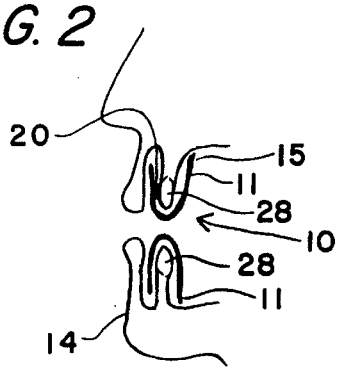
FIG. 3 is a sectional side view showing the protector shown in association with the teeth and gums of a user of the protector.
Figure 4:
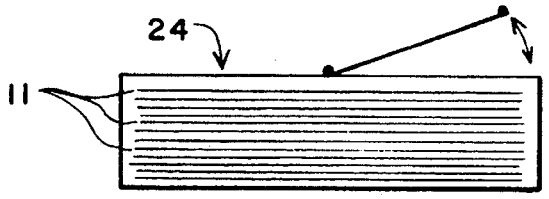
FIG. 4 is a vertical sectional view of a storage container containing a multitude of the shield devices.

Referring to FIGS. 1–3, an embodiment of the protector 10 of this invention is shown comprised of paired shield devices 11 exemplified as being of identical construction and disposed in facing upper and lower relationship.

Each shield device 11 is comprised of a thin, initially flat piece of film 12 of a polymer such as polyethylene or other polymers of comparable strength and relatively low cost. The piece of film 12 has a substantially rectangular perimeter defined by parallel end extremities 13 and by straight parallel first and second long edges 14 and 15, respectively, of substantially equal length. However, as shown in FIG. 1, the second edge in the exemplified embodiment is rounded to meet said end edge extremities. The piece of film has a plane of symmetry 16 that vertically bisects the film between end extremities 13.

Film 12 has two parallel slits 17 that begin at second edge 15 and proceed toward first edge 14. Said slits create center flap 18 and embracing outer flaps 19.

A strip 20 of compliant material is attached to the film along first edge 14. By "compliant", it is meant that strip 20, initially flat and coplanar, can be manipulated to achieve different contours which remain even when the deformational force is removed. Typical materials which may be utilized for strip 20 include cardboard and certain plastics containing a high percentage of fillers such as talc, having plate-like crystal structure. The height of the film, measured between first and second edges,may range from about 1½ to 2½ inches. The length of the film, measured between end extremities 13 may range from about 2½ to 3½ inches. The thickness of the film may range between 1 mil and 5 mils.

Adhesive means, in the form of adhesive strip 21 is disposed upon center flap 18, and adapted to secure said outer flaps when said outer flaps are moved so as to partially overlap said center i flat. Such disposition is shown in FIG. 2, wherein the overlapped regions 22 are of substantially triangular contour. Such securement of the overlapped outer flaps effectively shortens the length of said second edge. Suitable adhesive means include pressure-sensitive coatings having affinity for film 12 and which may be protected during storage by way of peel-off release papers 23.

In use, two of the shield devices are removed from stacked storage in a dispensing device 24 and placed in the mouth such that the first edges are disposed upon the front gum lines and the compliant strip is pressed against the gums. The film of the upper device is then drawn upwardly around the lower extremities of the teeth. Release paper strip 23 is removed, and outer flaps 19 are displaced toward center flap 18 so that a snug fit is secured. Outer flaps 19 are then pressed against adhesive means 21, causing securement of all three flaps. In such emplaced state, the device has a curved, trough-like shape, the bottom of the trough 25 accommodating the tips of teeth 28 . It is to be noted that, when properly emplaced, second edge 15 will be above first edge 14 in said upper device.

With respect to the lower device, placement is similar to that of the upper device except that certain positional relationships are symmetrically inverted. After use, the devices may be discarded.

In certain embodiments, supplementary adhesive, such as the paste products currently employed to secure dentures, may be used to further enhance retention of the shield devices. The lower surface 26 of film 12 may be provided with a zone of toughened texture 27 along the site where upper and lower teeth come together. The toughened texture provides better gripping of food during chewing.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A gum and teeth protector comprised of:

a) a piece of thin, initially flat polymeric film having a substantially rectangular perimeter defined by parallel end edges and straight parallel first and second edges of substantially equal length, said piece of film having two parallel slits beginning at said second edge and extending toward said first edge in orthogonal relationship thereto, said slits defining a center flap and paired outer flaps, the height of said piece of film, measured between said first and second edges being between 1½ to 2½ inches, b) a compliant strip disposed in association with said first edge, and c) adhesive means interactive between said center and outer flaps to securably overlap said center flap, thereby effectively shortening the length of said second edge.

2. The protector of claim 1 wherein the length of the piece of film, measured between said end extremities, is between 2½ and 3½ inches.

3. The protector of claim 2 wherein the thickness of said piece of film is between 1 and 5 mils.

4. The protector of claim 3 wherein overlapping of said outer flaps defines regions of triangular contour.

5. The protector of claim 4 wherein said adhesive means is a pressure-sensitive coating protected by a peel-off release paper.

6. A dispensing device comprising a multitude of the protectors of claim 5 stacked in flat form.

* * * * *